United States Patent [19]

Erickson et al.

[11] Patent Number: 4,815,983

[45] Date of Patent: Mar. 28, 1989

[54] CUSTOMIZABLE PLUGS FOR A.C. POWER CORDS

[75] Inventors: James W. Erickson, Plainview; Merlyn W. Jeche; Rolland D. O'Groske, both of Rochester; Gerald L. Richter, Zumbrota, all of Minn.

[73] Assignee: International Business Machines Corporation, Armonk, N.Y.

[21] Appl. No.: 120,063

[22] Filed: Nov. 13, 1987

[51] Int. Cl.[4] ..... H01R 29/00

[52] U.S. Cl. ..... 439/173; 439/172; 439/166

[58] Field of Search ..... 439/166–167, 439/170–175, 177, 217–218, 222–224, 628, 679

[56] References Cited

U.S. PATENT DOCUMENTS 1,932,018 10/1933 Hubbell, Jr. ..... 439/170
2,015,590 9/1935 Cavanagh et al. ..... 439/172
2,989,719 6/1961 Aarlaht ..... 439/172
4,416,502 11/1983 Rumble ..... 439/172
4,543,624 9/1985 Rumble ..... 439/173
4,626,052 12/1986 Rumble ..... 439/173

FOREIGN PATENT DOCUMENTS 0257482 3/1988 European Pat. Off. ..... 439/173

*Primary Examiner*—Gil Weidenfeld
*Assistant Examiner*—P. Austin Bradley
*Attorney, Agent, or Firm*—J. Michael Anglin

[57] ABSTRACT

A modular power-line attachment cord has a plug with standard pins in a cavity with a locking shoulder. A number of national-standard inserts have cooperating sockets for the pins, and a locking shoulder allowing the insert to be permanently captured in the cavity of the plug.

14 Claims, 3 Drawing Sheets

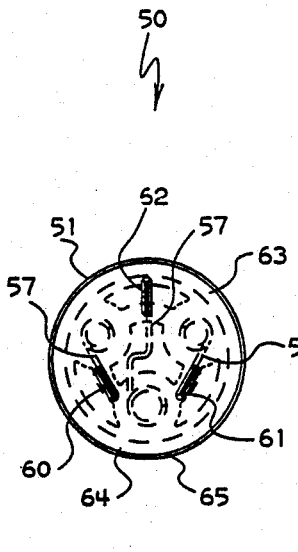
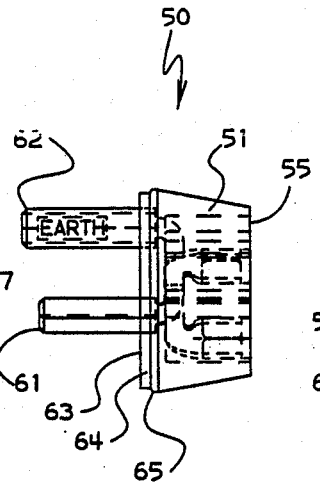
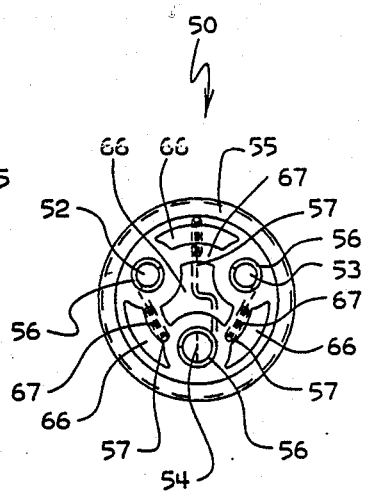
FIG. 7 FIG. 5 FIG. 6
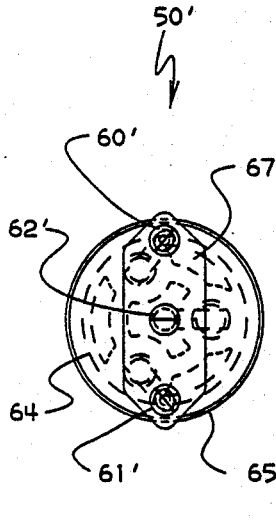
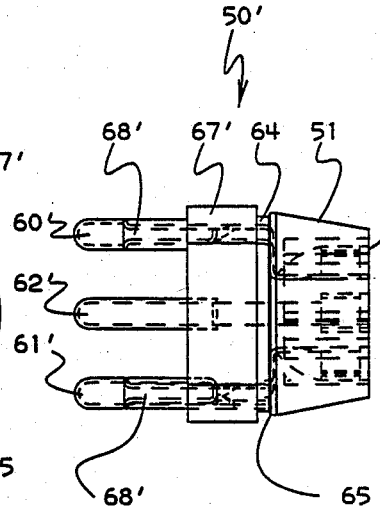
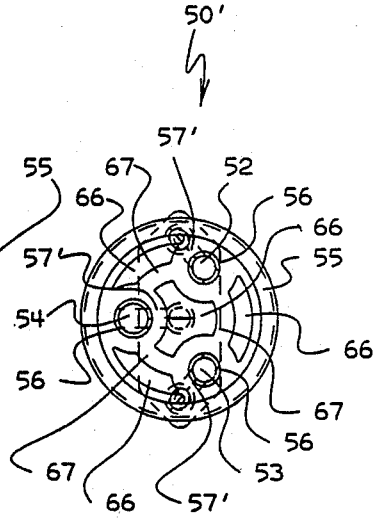
FIG. 10 FIG. 8 FIG. 9

CUSTOMIZABLE PLUGS FOR A.C. POWER CORDS

BACKGROUND

The present invention relates to electrical connectors, and particularly concerns a modular AC-power attachment cord customizable to a number of different national-standard wall sockets.

Electrical equipment such as minicomputers and personal computers obtain their primary electrical power from a standard wall outlet. It would be more accurate to say that their power is from one of a number of quasi-standard wall outlets, for the plethora of different plug styles in use throughout the world is striking. At the same time, rigid national electrical codes not only prescribe prong configurations, but also minute construction details of plugs, wires, mountings, fuses, and so on. Attempting to manufacture a small computer or other electrical appliance to be marketed worldwide is greatly complicated by this problem.

In the early days of electric-power distribution, when, as Ambrose Bierce remarked of electricity that "it is already proved that it will pull a street car better than a gas jet and give more light than a horse," the purchase of an electrical appliance entailed a trip to the hardware store for the right kind of plug to fit the local type of wall socket. H. Hubbell, U.S. Pat. No. 1,275,693, proposed to alleviate this problem with a plug having a threaded insert and a template which could capture a pair of prongs in different positions. This plug, of course, requires knowledge and assembly by the purchaser, and is prone to spontaneous disassembly with repeated use. This is typical of other art in this area, such as U.S. Pat. Nos. 2,989,719 and 3,382,475. U.S. Pat. Nos. 2,417,928 and 2,450,657 employ this basic concept for connecting the wires in a power cord in different ways, to accommodate different voltages. U.S. Pat. No. 3,996,546 is a more modern configuration, in which a single insert can be positioned in a plug body in two different ways for different voltages. Such plugs require some instructions to and assembly by the purchaser, and are prone to loosening and spontaneous disassembly with repeated use. They are not very safe. They provide little or no strain relief for a cord connected to them.

As an international lack of standardization superseded local lacks of standardization as the most significant problem, other solutions have been tried. Requiring the customer to obtain or install his own plug locally is not feasible. At the present time, the favored approach is to make up a number of different attachment cords, each having a different national plug molded on one end and a common socket (such as an IEC type) molded on the other end. The equipment has a fixedly mounted, recessed common receptacle which accepts the common socket. This solution leaves much to be desired. It allows the distinct possibility of having an electrically hot plug coming loose from the equipment, or being pulled out accidentally, and wandering about on the end of a wire to be grasped, become wet, etc. Such attachment cords can also be lost or replaced with lower-rated sets which are inadequate for the equipment, and thus dangerous. The cords cannot be tested for continuity and insulation strength ("hi-pot" tested) as a unit with its associated equipment.

The best solution is to hard-wire the equipment when it is manufactured with a power cord having a direct connection and mechanical strain relief in the equipment at one end, and having the correct national-standard plug molded onto the other end. This solution, however, is expensive and time-consuming to the point of impracticability in most situations. It can create dozens of sub-model designations for essentially the same product, with the attendant blizzard of paperwork and inventory problems.

SUMMARY OF THE INVENTION

The present invention provides an international power-attachment cord which is easily customized for a particular country either by the purchaser or at a final shipping point in the manufacture of electrical equipment. The power cord is safe, acceptable under the regulations of most if not all governments, and testable for continuity and hi-pot along with its equipment before shipment to the customer. The invention also provides a standard power connection for testing the associated equipment during manufacture. Finally, its pleasing visual design is important to customer acceptability.

Broadly speaking, the invention includes multiple conductors in a power cord, a connector shell having pins at standardized locations on an end wall and a locking shoulder at the distal end of a side wall, and a number of different inserts each having a body with sockets for receiving the pins, and blades connected thereto in a particular national configuration. The insert body has a locking shoulder cooperating with the shell's shoulder so as to capture the insert permanently inside the shell. The pins inside the shell are located and sized to prevent connecting the insert incorrectly.

The Drawing

FIG. 5 is a side view of one insert body according to the invention.

FIGS. 6 and 7 are end views of the insert body of FIG. 5.

FIG. 8 is a side view of another insert body according to the invention.

FIGS. 9 and 10 are end views of the insert body of FIG. 8.

DESCRIPTION OF A PREFERRED EMBODIMENT

Figure 1:
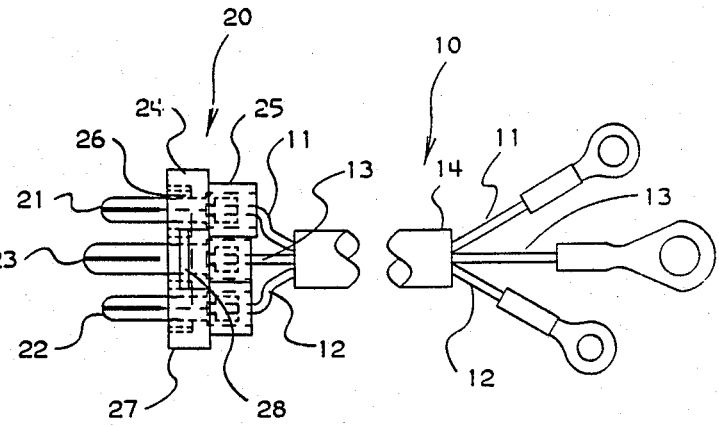
FIG. 1 is a side view of a cord and an inner body of a connector shell for a modular power plug according to the invention.

FIG. 1 shows a power cord and a core molding used in a modular plug set according to the invention. Cord 10 is of the type having two insulated power conductors 11, 12 and an insulated ground conductor 13 encased in a flexible plastic outer jacket 14. Premold core 20 carries three conductive pins 21–23, preferably made of brass, which are crimped to conductors 11–13 respectively inside the cylindrical body 24 of core 20. The pins are preferably slotted along most of their length. Insulating sleeves 25 integral with body 24 prevent loose strands from shorting one pin to another.

Figure 2:
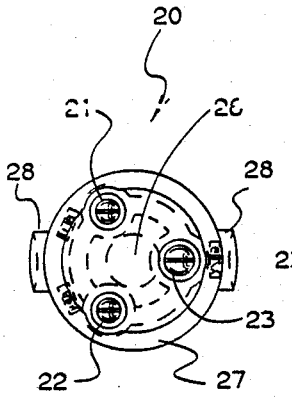
FIG. 2 is an end view of the inner body of FIG. 1.

FIG. 2 is an end view of core 24, showing pins 21–23 disposed in a circle. An asymmetry, however, is created by locating the circle slightly nonconcentric with core face 26, by positioning the pins slightly nonequidistantly around the circle, and by making pin 23 slightly larger in diameter and longer than pins 21, 22. An outer lip 27 extends around face 26. Ears 28 provide a locating means for core 20. Core body 24 is made of a relatively hard thermoplastic such as ABS, and is molded by a conventional process. Pins 21–23 are inserted into core 20 after they have been attached to conductors 11–13.

Figure 3:
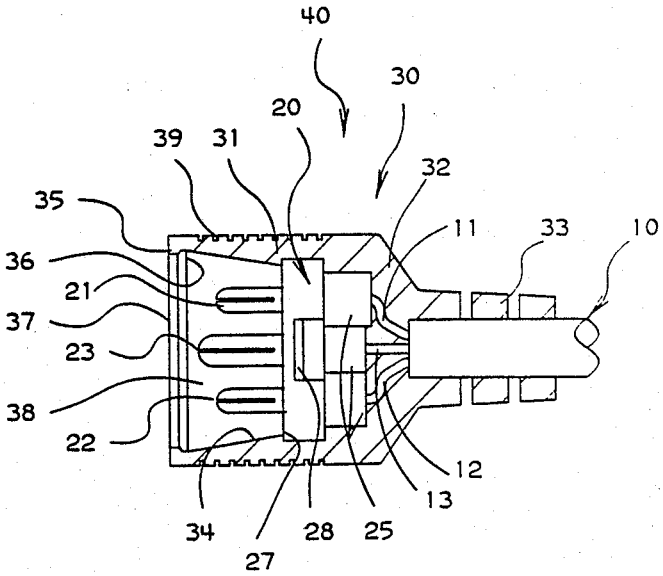
FIG. 3 is a side view in cross section of an assembled connector shell according to the invention.

FIG. 3 shows in cross section a connector shell 30 conventionally molded about core 20 and one end of cord 10, locking them into position to form a connector 40. Shell 30 has a generally cylindrical wall 31 extending over core 20 in both directions and past pins 21–23. An integral cap portion 32 joins wall 31 to a conventional stiffener 33, which provides strain relief for cord 10 yet allows limited bending. A shoulder 34 engages core lip 27 to prevent any relative movement of core 20 with respect to shell 30.

At its proximal end 35, wall 31 has a narrow square locking shoulder 36 formed therein, so as to define a circular aperture 37 slightly smaller than the diameter of the generally frustoconical cavity 38 occupied by pins 21–23. This configuration may also be described as a lip projecting inwardly from wall 31. For an outside shell diameter of 37 mm and a minimum shell wall thickness of 3 mm, the shoulder width may be quite small, on the order of 0.5 mm; the thickness of the aperture may also be relatively small, about 2.0 mm. The outer surface of cylindrical wall 31 carries a number of encircling grooves for a good hand grip. Connector shell 31 is made of a somewhat flexible material, preferably having a Shore D hardness of about 40; General Electric Lomod 150 (R) and Teknor Apex 4011 (R) polyvinyl chloride (PVC) are acceptable materials. This flexibility provides good protection of cord 10 by means of stiffener 33, gives a better hand grip on grooves 39, and allows the inserts described below to be captured easily yet retained tightly in cavity 38. The use of double-shot molding for the connector assembly prevents shorting of loose strands of wire from conductors 11–13. Ears 28 prevent any rotation of core 20 within shell 30.

Assembly 40 finds utility by itself as a standard power connection during the manufacture of its associated equipment. Cord 10 may be attached to the equipment at any time. The equipment may then be tested during and after manufacture by connecting a special non-capturable female power plug (not shown) to the pins 21–23. Since the configuration of pins 21–23 is the same for all destination countries, a single such plug is sufficient for testing any piece of equipment.

Figure 4:
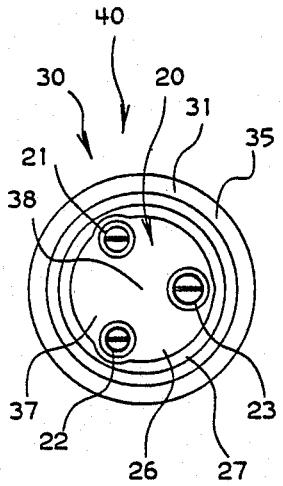
FIG. 4 is an end view of the connector shell of FIG. 3.

FIGS. 5–7 detail one insert 50 for use with the connector shell assembly shown in FIGS. 3–4. (This specific insert is for a 250-Volt, 10-Ampere power outlet used in Australia and New Zealand.) Adapter body 51 is molded of an insulating material such as Nylon or PVC. These materials are relatively hard, harder and less flexible than the material of shell 30, FIG. 3. Three sockets 52–54 formed in distal end 55 carry contacts 56 spaced and sized for connecting to pins 21–23, FIGS. 3–4. Thus, socket 54 is larger and deeper than the others, in order to accept the larger and longer pin 23. Conductors 57 connect the contacts of sockets 52–54 to respective ones of three blades 60–62 in the proximal surface 63 of insert body 51. Preferably, each contact 56, conductor 57, and a blade 60–62 is formed from a single piece of brass, then molded as a unit into insert 50.

A disk 64, having the same thickness as aperture 37, defines a further locking or retaining shoulder 65 having the same width as that of shoulder 36 in FIG. 3. Distal surface 55 may have cutouts 66 partially through the length of body 51, to reduce sinks and voids when molding the insert. Arcuate ribs 67 prevent the connector pins 21–23 from entering the cutouts. Body 51 is generally frustoconical in overall shape, preferably having a side angle of about 15 degrees, to conform to the inner surface of cavity 38, FIG. 3. The length of the insert body from shoulder 65 to distal end 55 is slightly shorter than the depth of the cavity from shoulder 36 to ring 34.

FIGS. 8–10 portray another insert 50'. (This insert fits 250-Volt, 16-Ampere wall sockets in Chile and Italy.) The body portion 51 of adapter 50' is the same as that of FIGS. 5–7, as are the sockets 52–54, contacts 55, disk 64, and locking shoulder 65. The blades 60'–62' differ in shape, are mounted on a hexagonal auxiliary body 67' and have insulating sleeves 68' in accordance with the electrical codes of the countries where it is employed. Note that the term "blade" as used herein encompasses variously shaped prongs or contact members for mating with the large number of national-standard power outlets.

Figure 11:
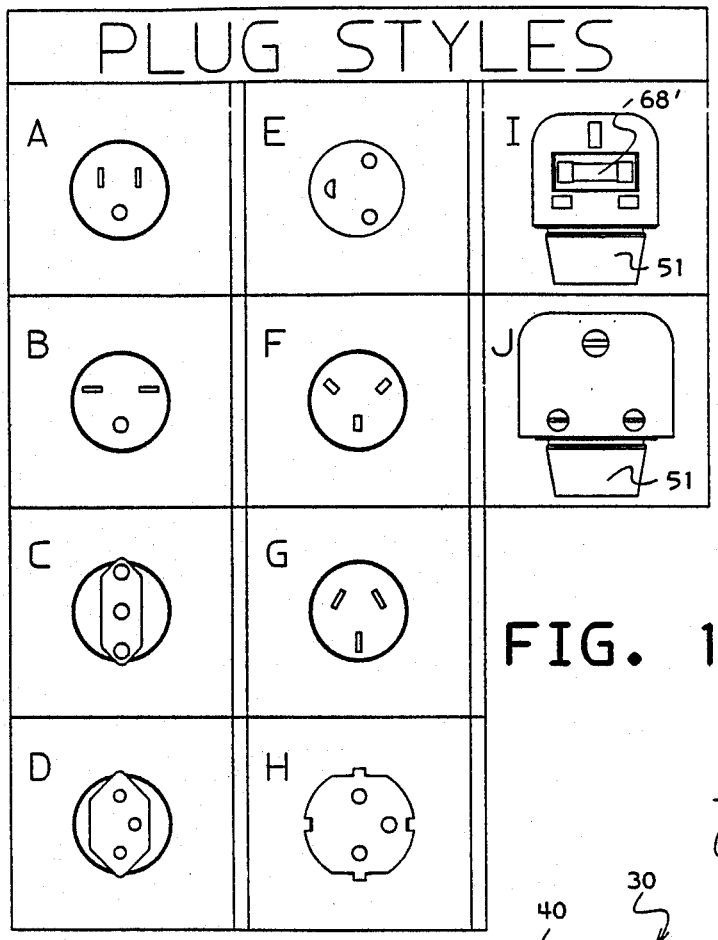
FIG. 11 shows are end views A through J of further insert bodies according to the invention.

FIGS. 11A–11J are end views of other national-standard plug configurations which can easily be incorporated into inserts such as those shown in FIGS. 5–9. Greatly differing base shapes can be accommodated by the use of an auxiliary body such as 67' shown in FIGS. 8–9. Such an auxiliary body can also incorporate other components, such as the fuse 68' of FIG. 11I. Also, an auxiliary body may be mounted at any angle with respect to insert body 51. IN FIGS. 11I and 11J, for example, body 51 is perpendicular to the direction of the blades.

Figure 12:
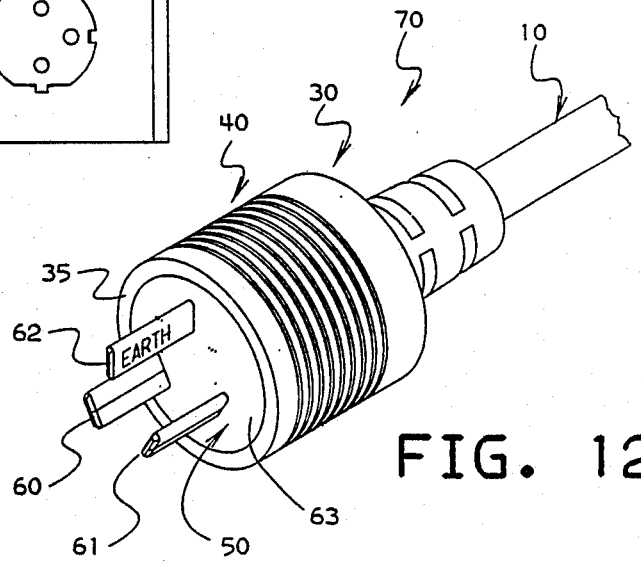
FIG. 12 is an isometric view of a completely assembled modular power-attachment cord according to the present invention.

FIG. 12 is an isometric view of an assembled attachment cord 70. To assemble a particular insert to the common connector and cord, one of the inserts 50 is rotated until its asymmetrically disposed sockets 52–54, FIG. 6, fit onto pins 21–23, FIG. 3. Then the insert body 51 is pushed axially into cavity 38, its frustoconical shape spreading aperture 37 until insert shoulder 65 passes shell shoulder 36, whereupon the insert is captured within cavity 38. If the length of insert body 41 is about the same as the depth of the cavity, further rearward movement after capture is prevented, and the insert is held snugly in position as though it had been molded in place. In the embodiment described above, an attempt to disassemble connector 40 (except possibly with specially designed tools) will destroy shell 30 before releasing insert 50.

We claim:

1. An attachment cord for electrical power, comprising:

a power cord having at least three mutually insulated conductors;

a connector for receiving one end of said cord, said connector including an end face, at least three pins fixed at standard locations within said end face and coupled to respective ones of said conductors, at least one of said pins being different from another of said pins, a side wall extending from said end face and defining a cavity in said connector, a first locking shoulder formed in said side wall and extending into said cavity;

a plurality of inserts, each said insert including a body, a plurality of sockets formed in said body at said standard locations for engaging respective ones of said pins, a plurality of blades fixed in said body of each insert in mutually different configurations, in accordance with a particular national arrangement, interconnection means for coupling predetermined ones of said sockets with respective ones of said blades, a further locking shoulder formed in said body and adapted to cooperate with said first locking shoulder so as to capture said insert in said cavity of said connector with said pins engaging said sockets.

2. A power attachment cord according to claim 1, wherein each said insert has a slightly frusto-conical body having a larger diameter near said blades than near said sockets.

3. A power attachment cord according to claim 2, wherein said insert body is a molded piece enclosing said sockets, said blades and said interconnection means.

4. A power attachment cord according to claim 3, wherein said plug insert body has a hardness greater than that of said connector side wall.

5. A power attachment cord according to claim 1, wherein said side wall is generally cylindrical, and said cavity has a slightly frusto-conical shape with a larger diameter near said first locking shoulder than near said end face.

6. A power attachment cord according to claim 5, wherein said side wall comprises a slightly flexible material.

7. A power attachment cord according to claim 6, wherein said locking shoulder forms a lip in a proximal end of said cylindrical side wall, and defines an aperture in said proximal end.

8. A power attachment cord according to claim 5, wherein said connector includes a molded insert holding said pins and forming at least a part of said end face, and a shell molded around said inner body and forming said side wall.

9. A power attachment cord according to claim 8, wherein said shell is also molded to said power cord so as to prevent relative movement between said cord and said insert.

10. A power attachment cord according to claim 5, wherein said at least three pins are disposed in a non-symmetric configuration on said end face.

11. A power attachment cord according to claim 10, wherein said pins are disposed substantially in a circle nonconcentric with said cavity and projecting from said end face.

12. A power attachment cord according to claim 10, wherein at least one of said pins is substantially longer than the others of said pins.

13. A power attachment cord according to claim 10, wherein said pins are substantially cylindrical.

14. A power attachment cord according to claim 13, wherein at least one of said pins has a larger diameter than another of said pins.

* * * * *